US012357083B1

(12) United States Patent
Noah

(10) Patent No.: US 12,357,083 B1
(45) Date of Patent: Jul. 15, 2025

(54) HEIGHT ADJUSTABLE DESK

(71) Applicant: Nathaniel Noah, Graham, NC (US)

(72) Inventor: Nathaniel Noah, Graham, NC (US)

( * ) Notice: Subject to any disclaimer, the term of this patent is extended or adjusted under 35 U.S.C. 154(b) by 0 days.

(21) Appl. No.: 18/910,561

(22) Filed: Oct. 9, 2024

(51) Int. Cl.
*A47B 9/18* (2006.01)

(52) U.S. Cl.
CPC ..... *A47B 9/18* (2013.01); *A47B 2009/185* (2013.01)

(58) Field of Classification Search
CPC ..... A47B 9/16; A47B 9/18; A47B 2009/185
See application file for complete search history.

(56) References Cited

U.S. PATENT DOCUMENTS

| | | | | |
|---|---|---|---|---|
| 4,860,668 | A | 8/1989 | Baudenbacher | |
| 6,003,450 | A * | 12/1999 | Bruckner | A47B 9/18 108/71 |
| 9,861,192 | B2 | 1/2018 | Wu | |
| 10,085,550 | B1 | 10/2018 | Hsu et al. | |
| 10,258,148 | B1 | 4/2019 | Donner et al. | |
| 10,413,053 | B2 | 9/2019 | Flaherty et al. | |
| 10,499,730 | B2 | 12/2019 | Kim et al. | |
| 10,791,826 | B2 * | 10/2020 | Crowe | A47B 9/16 |
| 11,076,688 | B2 * | 8/2021 | Ergun | A47B 9/00 |
| 11,395,544 | B1 | 7/2022 | Poniatowski | |
| 12,029,315 | B1 * | 7/2024 | Meyer | A47B 9/02 |
| 2017/0196351 | A1 * | 7/2017 | Failing | A47B 21/02 |
| 2017/0273453 | A1 * | 9/2017 | Wu | A47B 13/081 |
| 2017/0354245 | A1 * | 12/2017 | Martin | A47B 21/02 |
| 2018/0255919 | A1 * | 9/2018 | Swartz | A47B 9/12 |
| 2020/0281349 | A1 * | 9/2020 | Grabowski | A47B 13/088 |
| 2022/0295982 | A1 * | 9/2022 | Zheng | A47B 9/10 |
| 2022/0354246 | A1 * | 11/2022 | Wang | A47B 21/0314 |
| 2023/0084474 | A1 * | 3/2023 | Messick, Jr. | B65G 23/06 198/834 |

OTHER PUBLICATIONS

Lorell/Rocelco standing desk deluxe floor stand legs for DADR-40 and DADR-46 (R DADRB-FS) URL: https://www.upmostoffice.com/products/desk-riser-floor-stand Accessed/Published Date: Jul. 9, 2024.

* cited by examiner

*Primary Examiner* — Daniel J Rohrhoff
(74) *Attorney, Agent, or Firm* — Ashley D. Johnson; Dogwood Patent and Trademark Law

(57) ABSTRACT

The invention is a variable height desk that easily and efficiently converts from a first, lowered orientation suitable for use while sitting and a second, raised orientation suitable for use while standing. The desk includes a desktop that can be positioned in one or more stopped locations above a base support. In the lowered configuration, a user can sit at the desk with their legs positioned underneath the desktop. In the raised configuration, the user can stand and still have access to the top of the desktop. The desk also includes first and second sets of scissor arms that couple the desktop to the base and enable the desktop to be raised and lowered.

13 Claims, 14 Drawing Sheets

HEIGHT ADJUSTABLE DESK

FIELD OF THE INVENTION

The presently disclosed subject matter relates to a desk that has a top surface (e.g., desktop) configured to raise and lower on demand to provide for both standing desk and sitting desk options.

BACKGROUND OF THE INVENTION

Students and many adults spend a considerable amount of time using desks during the workweek (e.g., at school or at work performing job duties). To this end, existing desks typically include a uniform consistent height that limits users to sitting in a chair while the desktop surface supports a computer, phone, books, etc. However, sitting for extended periods of time has been shown to be a leading cause of back and cervical pain, as well as cardiovascular disease, diabetes, and obesity. Thus, taking regular breaks from prolonged sitting can have numerous benefits. For example, standing can provide workers and students with more energy during the workday compared to sitting. In addition, standing burns more calories, resulting in weight loss without changes in diet or exercise. Further, standing promotes concentration and focus, such that users are more productive.

In response to the negative characteristics associated with conventional desks, height adjustable desks have been developed. However, the majority of prior art height adjustable desks move up and down using a motor, a pneumatic piston cylinder, a hydraulic cylinder, and/or electricity. The prior art desks are therefore costly to manufacture and complicated to use. In addition, not all buildings and/or rooms are electrically wired to accommodate multiple outlets for the desks. For example, classrooms can include 30 or more students but typically are limited to 5 or fewer electrical outlets. It would therefore be beneficial to provide a height adjustable desk that overcomes the shortcomings of the prior art.

SUMMARY OF THE INVENTION

In some embodiments, the presently disclosed subject matter is directed to a variable height desk. The desk includes a desktop defined by a planar and flat top surface, an opposed bottom surface, a front and an opposed back, and first and second sides. "Variable height" refers to a desk that has a minimum height, a maximum height, and any of a wide variety of heights therebetween.

The desk also includes a base comprising a first leg, a second leg, a third leg, and a fourth leg, each leg defined by a top end and an opposed bottom end. The base includes a frame comprising a first frame arm extending between the top end of the first leg and the top end of the second leg. The frame includes a second frame arm extending between the top end of the third leg and the top end of the fourth leg, wherein the first frame arm is parallel to the second frame arm. The frame includes a front frame arm with a first end attached perpendicularly to the first frame arm and a second end attached perpendicularly to the second frame arm. The frame includes a back frame arm with a first end attached perpendicularly to the first frame arm and a second end attached perpendicularly to the second frame arm.

The frame also includes a first bumper positioned on the first frame arm and extending upwardly therefrom, positioned adjacent to the first end of the front frame arm. The frame includes a second bumper positioned on the first frame arm and extending upwardly therefrom, positioned adjacent to the second end of the front frame arm. The frame includes a third bumper positioned on the second frame arm and extending upwardly therefrom, positioned adjacent to the first end of the front frame arm. The frame includes a fourth bumper positioned on the second frame arm and extending upwardly therefrom, positioned adjacent to the second end of the front frame arm. The desk includes a first lower connection element positioned on an interior face of the front frame arm and second lower connection element positioned on an interior face of the back frame arm, wherein the first lower connection element faces the second lower connection element.

The desk includes a first upper connection element positioned on the bottom surface of the tabletop and second upper connection element positioned on the bottom surface of the tabletop, wherein the first upper connection element faces the second upper connection element.

The desk comprises coupled first and second front scissor arms positioned adjacent to the front frame arm, wherein each of the first and second front scissor arms has a lower end and a top end. The desk includes coupled first and second rear scissor arms positioned adjacent the back frame arm, wherein each of the first and second rear scissor arms has a lower end and a top end. The lower end of the second front scissor arm and the lower end of the first rear scissor arm are each pivotally attached to the first frame arm. The upper end of the first front scissor arm and the upper end of the second rear scissor arm are each pivotally attached to the bottom surface of the tabletop. The lower end of the first front scissor arm is connected to the first lower connection element and the lower end of the second rear scissor arm is connected to the second lower connection element such that the lower end of the first front scissor arm and the lower end of the second rear scissor arm are configured to move along the first and second lower connection elements, respectively, and the lower end of the second rear scissor arm and the lower end of the first front scissor arm are connected together via a lower bar. The upper end of the second front scissor arm is connected to the first upper connection element and the upper end of the first rear scissor arm is connected to the second upper connection element such that the upper end of the second front scissor arm and the upper end of the upper end of the first rear scissor arm are configured to move along the first and second upper connection elements, respectively, and the upper end of the second front scissor arm and the upper end of the first rear scissor arm are connected together via an upper bar.

The desk includes a locking mechanism comprising a control lever with a first handle end and an opposed second end housed within a channel of a top plate defined by a pair of opposed spacers. The locking mechanism includes a first push bar that is not welded, positioned in an opening in the top plate, a second push bar welded into the top plate, and a spring positioned between the first and second push bars, and a hook that passes through an opening on the first push bar, spring, and second push bar, the hook including a hooked end attached to the upper bar. The locking mechanism transitions from a first locked orientation wherein the plate cannot move along a length of the hook and a second unlocked orientation wherein the second end of the control lever pushes against the first push bar to compress the spring, allowing the plate to move along a length of the hook, allowing the top end of the first rear scissor arm and the top end of the second front scissor arm to move along the upper connection element and also allowing the bottom end of the first front scissor arm and the bottom end of the second rear scissor arm to move along the lower connection element. The desk can transition between a first orientation defined by a vertically elevated desktop and a second orientation defined by a lowered desktop.

In some embodiments, each of the legs has a length of about 2-5 feet.

In some embodiments, the desk includes a horizontal crossbar that connects one of the plurality of legs to an adjacent leg, wherein the crossbar is positioned adjacent to the bottom end of both legs.

In some embodiments, the desk comprises a pair of beams, each beam attached to the bottom end of two legs.

In some embodiments, the front frame arm attaches to the first frame arm and second frame arm along a length of the first frame arm and along a length of the second frame arm, and not at the first end or second end of the first frame arm or second frame arm, and wherein the back frame arm attaches to the first frame arm and second frame arm along a length of the first frame arm and along a length of the second frame arm, and not at the first end or second end of the first frame arm or second frame arm.

In some embodiments, the first and second lower connection elements and the first and second upper connection elements are configured as tracks. The term "track" refers to a path or course along which an object moves (e.g., one end of a scissor arm). The track can therefore include a recess or channel for receiving a fastener or other device positioned on the adjacent end of a scissor leg, allowing that scissor leg to travel long the track (forwards or backwards) to lower or raise the scissor legs.

In some embodiments, the bumpers each have a height of about 1-5 inches.

In some embodiments, the desk includes a center pivot bar that connects each of the first front scissor arm, second front scissor arm, first rear scissor arm, and second rear scissor arm together.

In some embodiments, the presently disclosed subject matter is directed to a method of raising or lowering the desktop of the disclosed table. Particularly, to lower the desk, the method comprises lifting the first handle end of the control lever to the unlocked orientation, allowing the second end of the control lever to push against the first push bar to compress the spring, allowing the plate to move along a length of the hook, allowing the top end of the first rear scissor arm and the top end of the second front scissor arm to move along the upper connection element and also allowing the bottom end of the first front scissor arm and the bottom end of the second rear scissor arm to move along the lower connection element. The method includes applying pressure to the desktop in a downward direction (e.g., towards the floor) to lower the desktop to a lowered configuration (e.g., from a first height to a second height that is lowered compared to the first height). Alternatively, gravity alone can be used to lower the desk once unlocked (no downward applied pressure is needed). To raise the desk, an upward pulling motion can be used to raise the desktop at any time (e.g., the handle does not need to be lifted to move the lever to the unlocked orientation). In this way, the desktop is raised or lowered as desired by the user.

In some embodiments, the desktop can be positioned between a maximum height and a minimum height.

In some embodiments, the bottom surface of the desktop rests upon the bumpers when in a fully lowered configuration.

The lifting is performed by the user or gravity, and no motor, pneumatic piston cylinder, or hydraulic cylinder is required.

In some embodiments, the presently disclosed subject matter is directed to a method of lowering and/or raising the disclosed desk. Specifically, the desk can be lowered by lifting the first handle end of the control lever to the unlocked orientation, allowing the second end of the control lever to push against the first push bar to compress the spring. The plate is then allowed to move along a length of the hook, allowing the top end of the first rear scissor arm and the top end of the second front scissor arm to move along the upper connection element and also allowing the bottom end of the first front scissor arm and the bottom end of the second rear scissor arm to move along the lower connection element. Pressure is then applied in a downward direction to the desktop or gravity alone can be used to move the desktop to a lowered height. To raise the height of the desktop, the desktop can be lifted using an upward lifting motion, without requiring lifting the first handle end of the control lever to the unlocked orientation. In these ways, the desktop is raised or lowered as desired by the user.

DETAILED DESCRIPTION OF THE INVENTION

Figure 1:
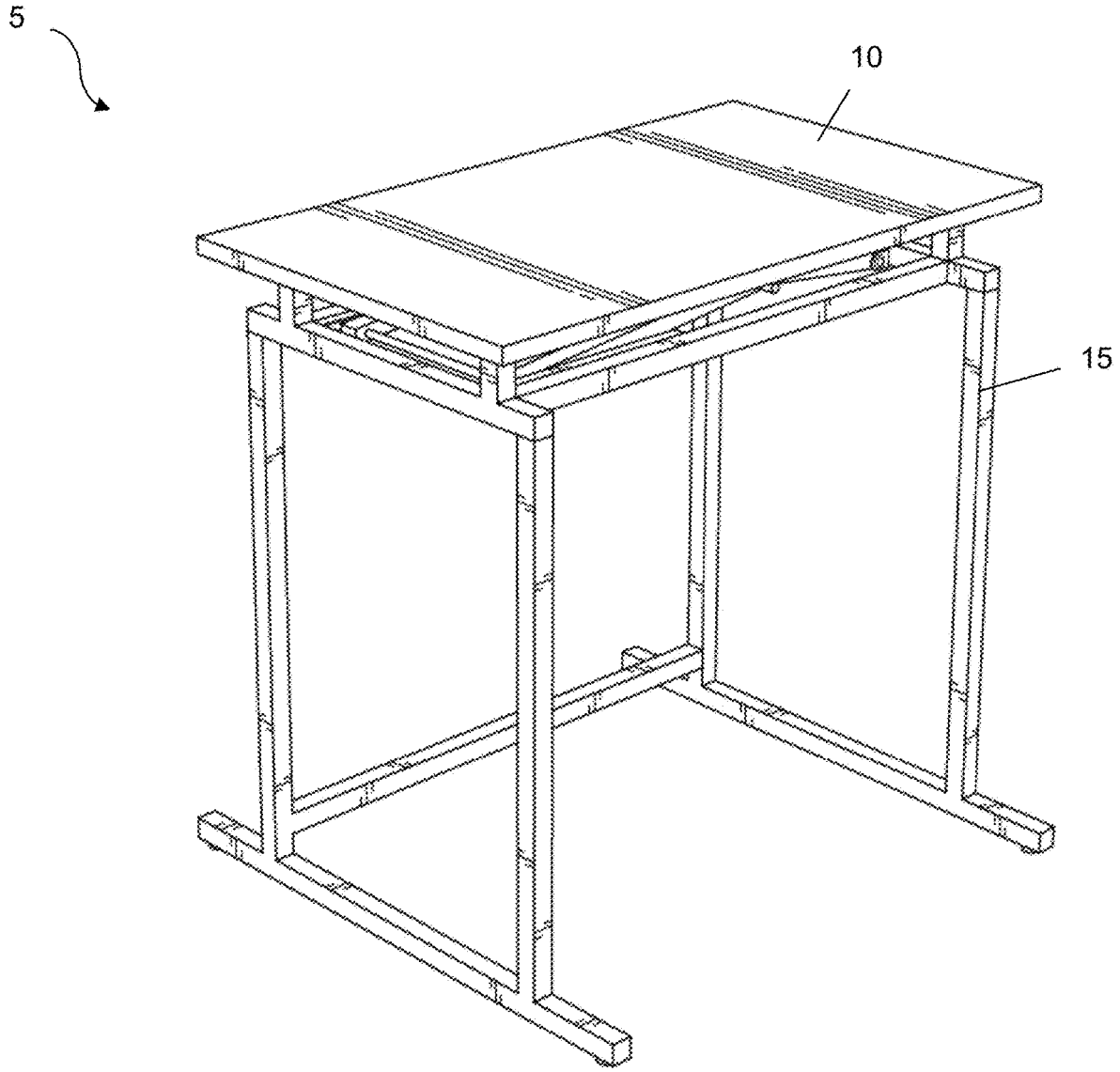
FIG. 1 is a perspective view of a height adjustable desk in accordance with some embodiments of the presently disclosed subject matter.

For the purpose of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e., at least one) of the grammatical object of the article. By way of example, "an element" means at least one element and can include more than one element. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods. Thus, the term "about" is used to provide flexibility to a numerical range endpoint by providing that a given value may be "slightly above" or "slightly below" the endpoint without affecting the desired result.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any unclaimed element as essential to the practice of the invention.

Unless otherwise defined, all technical terms used herein have the same meaning as commonly understood by one of ordinary skill in the art to which this disclosure belongs.

The presently disclosed subject matter is directed to a variable height desk that easily and efficiently converts from a first, lowered orientation suitable for use while sitting and a second, raised (e.g., extended) orientation suitable for use while standing. The term "desk" broadly refers to any support surface, such as a conventional desk, table, shelf, and/or workbench. The disclosed desk includes a desktop that can be positioned in one or more stopped locations above a base support. In the lowered configuration, a user can sit at the desk with their legs positioned underneath the desktop. In the raised configuration, the user can stand and still have access to the top of the desktop. As described in detail below, the disclosed desk can easily transition between the lowered and raised configurations, allowing for easy transition between sitting and standing use.

FIG. 1 illustrates one embodiment of desk 5 in a first, lowered configuration suitable for users in a seated position. As illustrated, the desk includes desktop 10 that provides a flat surface for writing, supporting a computer, and the like. The desktop rests upon and is supported by base 15. The desk also includes first and second sets of scissor arms that couple the desktop to the base and enable the desktop to be raised and lowered, as described in detail below.

Figure 2A:
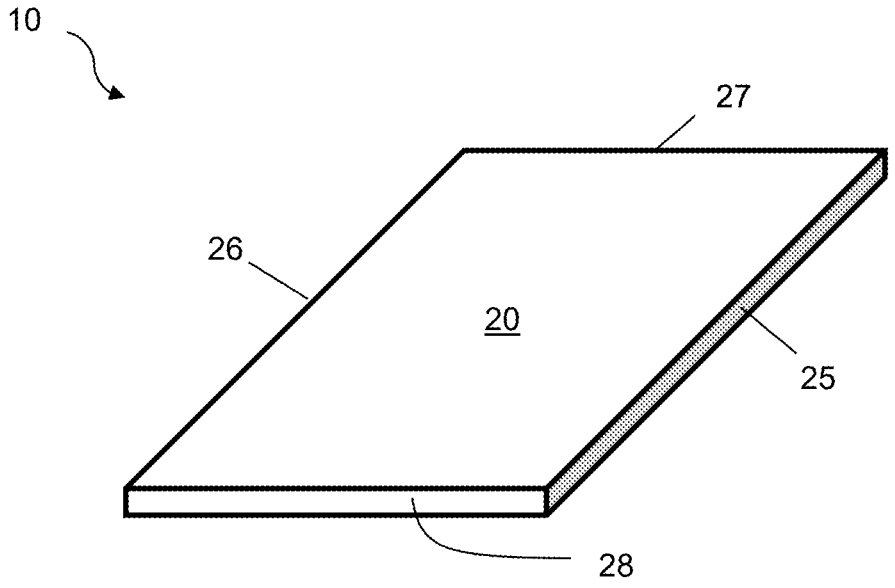
FIG. 2*a* is a perspective view of a desk desktop in accordance with some embodiments of the presently disclosed subject matter.
Figure 2B:
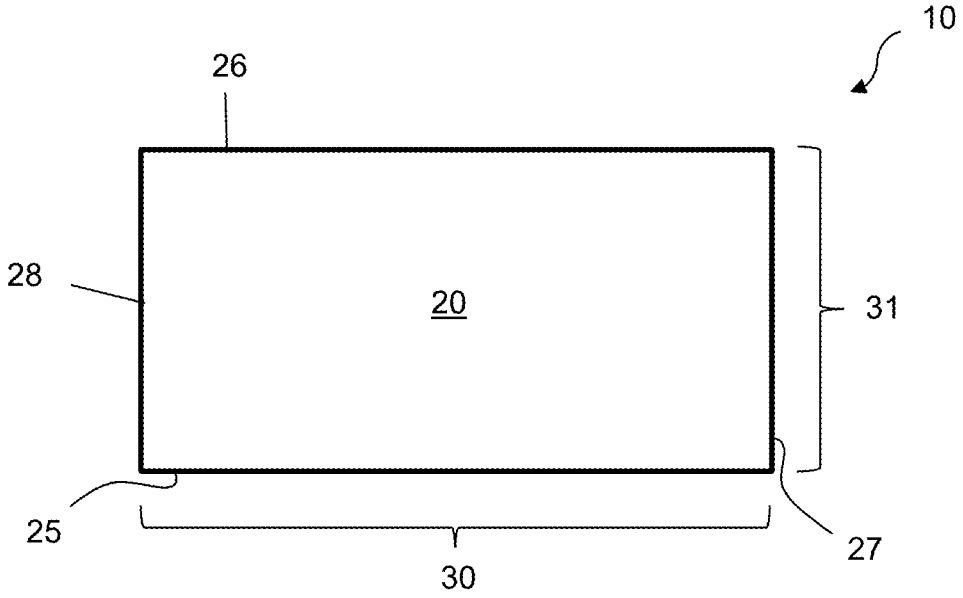
FIG. 2*b* is a top plan view of a desk desktop in accordance with some embodiments of the presently disclosed subject matter.
Figure 2C:
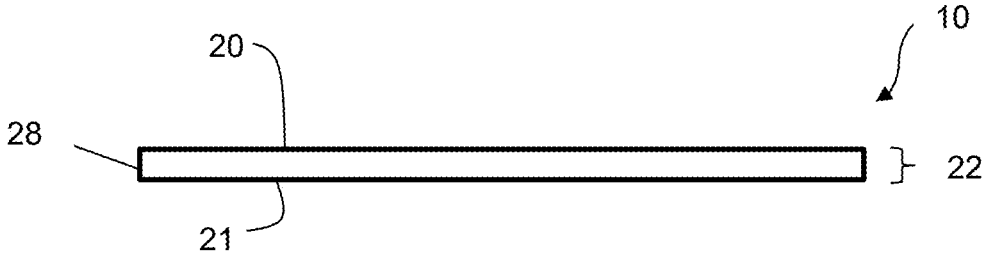
FIG. 2*c* is a side plan view of a desk desktop in accordance with some embodiments of the presently disclosed subject matter.

FIGS. 2*a*-2*c* illustrate one embodiment of desktop 10. The term "desktop" broadly refers to the uppermost planar, flat work surface of a desk. As shown, the desktop includes top surface 20 and opposed bottom surface 21 with thickness 22 therebetween. The desktop also includes front 25, opposed back 26, and first and second sides 27, 28. The desktop is configured to be vertically elevated and/or lowered with respect to base 15.

Although shown as being rectangular in shape in the Figures, it should be appreciated that desktop 10 can be configured in a variety of shapes. For example, the desktop can include any desired shape, such as (but not limited to) square, oval, circular, rectangular, abstract, and the like. The top and/or bottom faces of the desktop can be planar to accommodate writing, holding a book, and the like. The term "planar" refers to a characteristic of a surface in which the points of the surface have a curvature of about zero (e.g., flat or about flat). Thus, school or work tools (e.g., computer, books, keyboard) can be securely placed on the top face of desktop 10.

Desktop 10 can be configured in any desired size. For example, the desktop can have any desired length 30 and width 31, as shown in FIG. 2*b*. For example, desktop 10 can include a length and/or width of about 10-100 inches (e.g., at least/no more than about 10, 15, 20, 25, 30, 35, 40, 45, 50, 55, 60, 65, 70, 75, 80, 85, 90, 95, or 100 inches). The term "length" refers to the longest straight line (e.g., horizontal) distance of the desktop (e.g., between side edges 27, 28). The term "width" refers to the longest straight line perpendicular to the length (e.g., between the front and rear faces of the desktop). The desktop can also include thickness 22 of about 0.1-15 inches (e.g., at least/no more than about 0.1, 0.5, 1, 2, 3, 4, 5, 6, 7, 8, 9, 10, 11, 12, 13, 14, or 15 inches). The term "thickness" refers to the distance between top and bottom surfaces 20, 21 of desktop 10.

It should be appreciated that the dimensions of the desktop are not limited to the ranges above and can include a length, width, and/or thickness greater or less than the noted ranges.

Desktop 10 can be constructed from any suitable rigid material, such as (but not limited to) wood, metal (e.g., steel, stainless steel, aluminum, brass, bronze), plastic, glass, plexiglass, carbon fiber, fiberglass, tile, or combinations thereof.

Figure 3A:
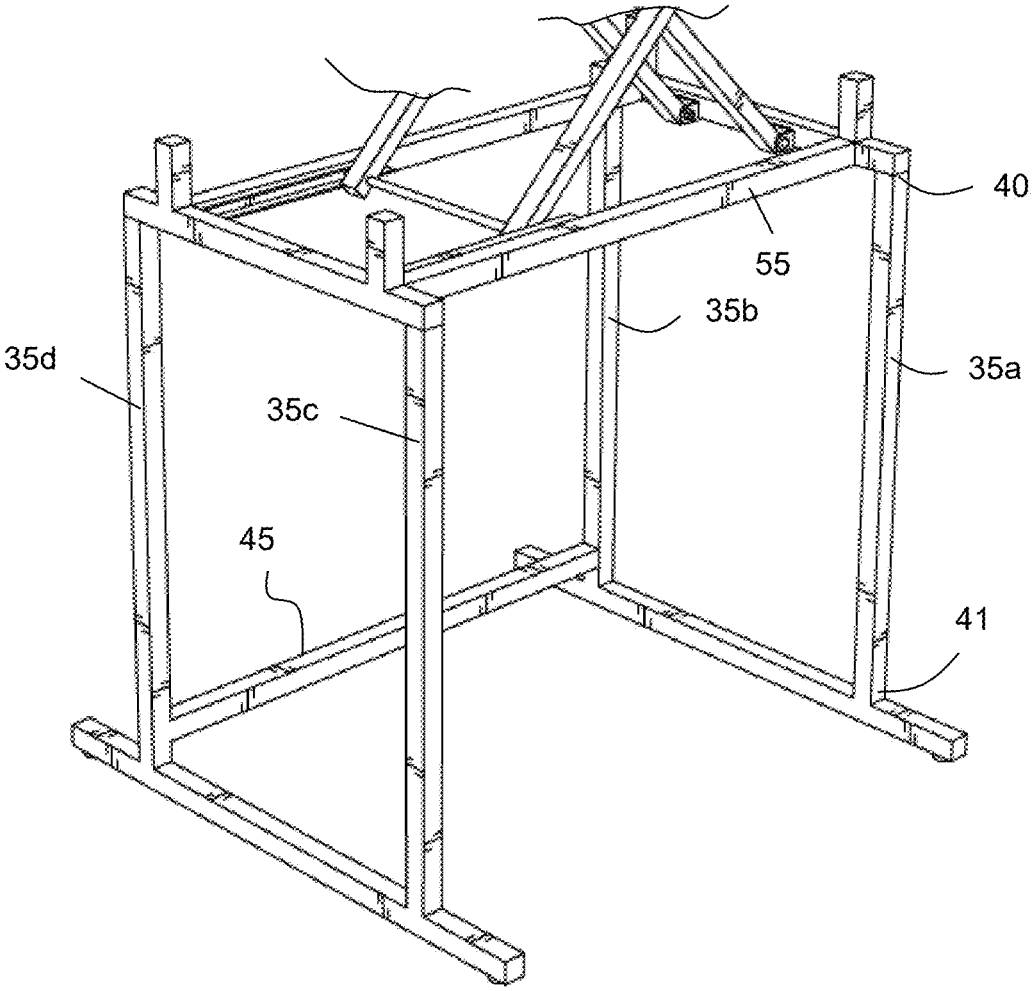
FIG. 3*a* is a perspective view of a desk base in accordance with some embodiments of the presently disclosed subject matter.

As mentioned above, the desktop is supported by base 15 that forms a lower portion of height-adjustable desk 5. As illustrated in FIG. 3*a*, base 15 comprises a plurality of legs 35*a*, 35*b*, 35*c*, and 35*d*, each defined by top end 40 and bottom end 41. It should be appreciated that the base can include any number of legs (e.g., 2, 3, 4, or more). Each leg can be about vertical in some embodiments. In other embodiments, the legs can be angled relative to desktop 10.

Legs 35*a*, 35*b*, 35*c*, and 35*d* each include top end 40 and bottom end 41, as shown in FIG. 3*a*. Each leg can have a length of about 2-5 feet (e.g., at least/no more than about 2, 2.5, 3, 3.5, 4, 4.5, or 5 feet). The length of each leg is defined as the straight-line distance between top and bottom ends 40, 41. Each leg can be configured with any desired cross-sectional shape (e.g., square, oval, round).

In some embodiments, the base can include at least one crossbar 45 that connects one adjacent leg to another. The crossbar can be horizontal, connecting adjacent legs to stabilize and strengthen the leg assembly. In some embodiments, the crossbar can be positioned adjacent to bottom end 41 of adjacent legs (e.g., about 0.1, 0.25, 0.5, 0.75, or 1 inch above bottom end 41). It should be appreciated that crossbar 45 is optional and the base can include embodiments with no crossbar.

Figure 3B:
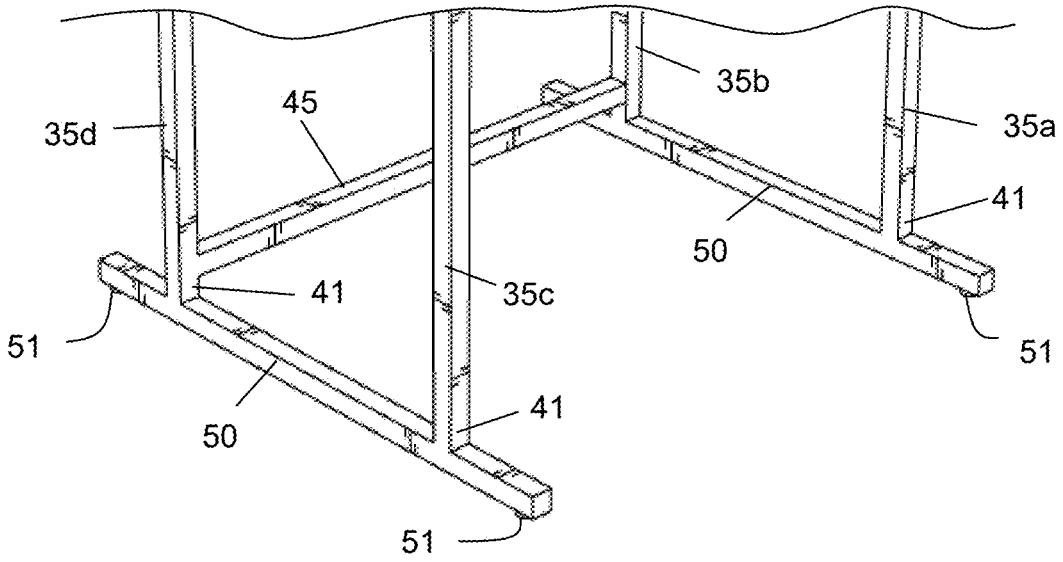
FIG. 3*b* is a fragmentary perspective view of a desk base bottom region in accordance with some embodiments of the presently disclosed subject matter.

The base can include a pair of beams 50 that extend transversely to the legs. As shown in FIG. 3*b*, each beam can connect with bottom end 41 of two legs using any mechanism (e.g., welding, adhesive, thermoforming). In some embodiments, the beams include leveling feet 51 positioned on the beams, adjacent to the support surface (e.g., floor) to assist in leveling the base and/or to protect flooring from scrapes, scratches, and other damage. The leveling feet can be configured as rubber, cloth, and/or plastic discs in some embodiments. Each beam can have a length of about 1-4 feet (e.g., at least/no more than about 1, 2, 3, 4 feet).

Figure 3C:
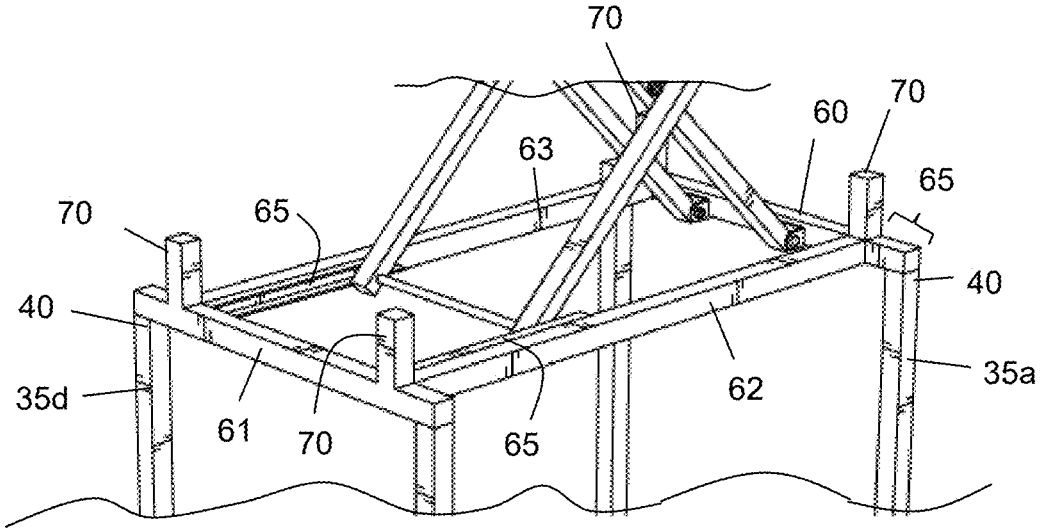
FIG. 3*c* is a fragmentary perspective view of a desk base upper region in accordance with some embodiments of the presently disclosed subject matter.

Top end 40 of each leg is connected to frame 55 that supports the first and second sets of scissor arms. As shown in FIG. 3*c*, the frame includes a first pair of frame arms (first frame arm 60 and second frame arm 61) that can be configured to be parallel to each other and/or beams 50 in some embodiments. The first pair of frame arms can extend between the corresponding legs with no overhang (e.g., the length of the first and second frame arms are determined by the distance between the adjacent legs). Stated another way, the distance between legs 35*a* and 35*b* is equivalent to the length of first frame arm 60. Likewise, the distance between legs 35*c* and 35*d* is equivalent to the length of second frame arm 61.

Figure 3D:
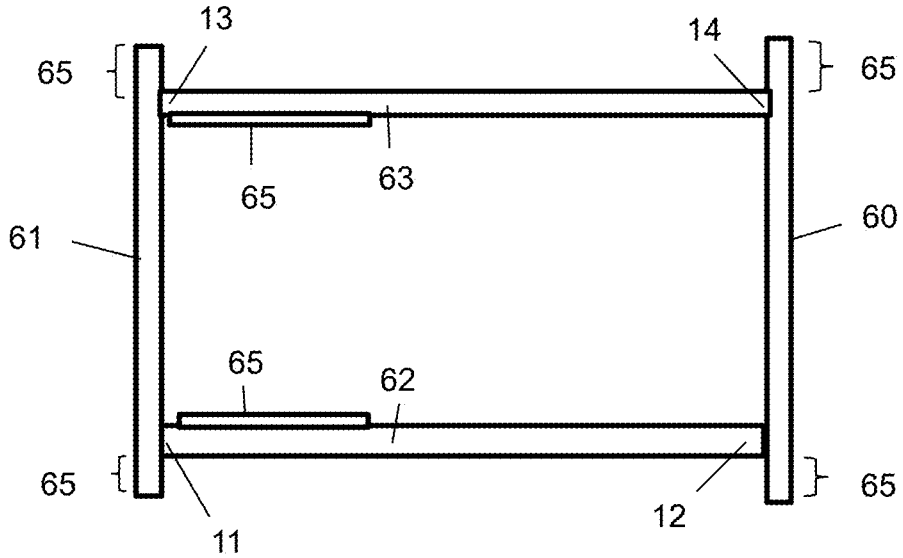
FIG. 3*d* is a top plan view of frame arms in accordance with some embodiments of the presently disclosed subject matter.

The frame also includes a second pair of frame arms (front frame arm 62 and back frame arm 63) that run perpendicular to and connect to the first pair of support arms. Specifically, first end 11 and second end 12 of the front frame arm attach to the first and second frame arms 60, 61. Similarly, first and second ends 13, 14 of the back frame arm contact and attach to the first and second frame arms, as shown in FIG. 3*d*. The first and second frame arms 60, 61 therefore join with the front and back frame arms to create a closed rectangular or square.

As illustrated, front and back frame arms 62, 63 are inset from the legs (e.g., configured toward each other), leaving overhang 65 on each end of the first pair of frame arms 60, 61. Beneficially, the overhangs provide support and added stabilization for the upper end of each leg. Thus, the function of the overhangs can be to connect and maintain contact with the legs, attaching the legs to the frame. The legs are therefore positioned adjacent to and outside of the interior rectangular structure created by the frame, as shown in FIG. 3*c*.

Each of the front and back frame arms 62, 63 includes lower connection element 65 positioned on an interior surface of the frame (e.g., the two connection elements face each other). The connection elements can be positioned on the second side of the frame, adjacent to second frame arm 61. In some embodiments, each connection element can be configured as a track that cooperates with the scissor arms, allowing movement as discussed in detail below. The track can be attached to the interior of the front and back frame arms using any suitable technique. The top edge of the connection element is level with the front and back frame arms, hiding the connection element from view and providing an aesthetically pleasing desk.

The frame can also include a plurality of bumpers 70 that extend upwards from the frame, as illustrated in FIG. 3*c*. The bumpers provide a surface upon which the desktop can rest when the desk is in the lowered (collapsed) position. The bumpers also create space to house the collapsed hardware (scissor arms). The bumpers are positioned at the junction between the first and second frame arms and the front and back frame arms, as shown. In this way, the bumpers are supported by the frame arms, allowing the bumpers to fully support the weight of the desktop securely. Thus, the bumpers provide a positive stop for the fully lowered position of the desktop by limiting further travel downward. Each bumper 70 can have a height of about 1-5 inches (e.g., at least/no more than about 1, 2, 3, 4, or 5 inches). Each of the frame bumpers is the same height, allowing the desktop to provide a flat surface when lowered. Bumpers 70 may be formed from an elastomeric material (such as rubber) and/or a stiff material, such as a metal or polymer.

Base 15 can be constructed from any suitable rigid material. For example, the base can be constructed from metal (steel, stainless steel), wood, plastic, or combinations thereof. In some embodiments, the materials used can be strong, withstanding the weight of the desktop, scissor arms, and any additional materials (e.g., computer positioned on the desktop).

As noted above, desk 5 also includes first and second sets of scissor arms that couple the desktop to the base and enable the desktop to be raised and lowered. The two sets of arms act as a height adjustment mechanism. Each set of scissor arms connect at a pivot point (centrally hinged) along their lengths so that the arms are configured to move in a scissoring motion to raise and lower the upper work surface desktop. Thus, the pivot point allows then arms to rotate as part of the scissor motion of height adjustment mechanism. An upward or downward motion causes the distal ends of the two pairs of scissor arms to move either left or right, raising or lowering the desktop.

Figure 4A:
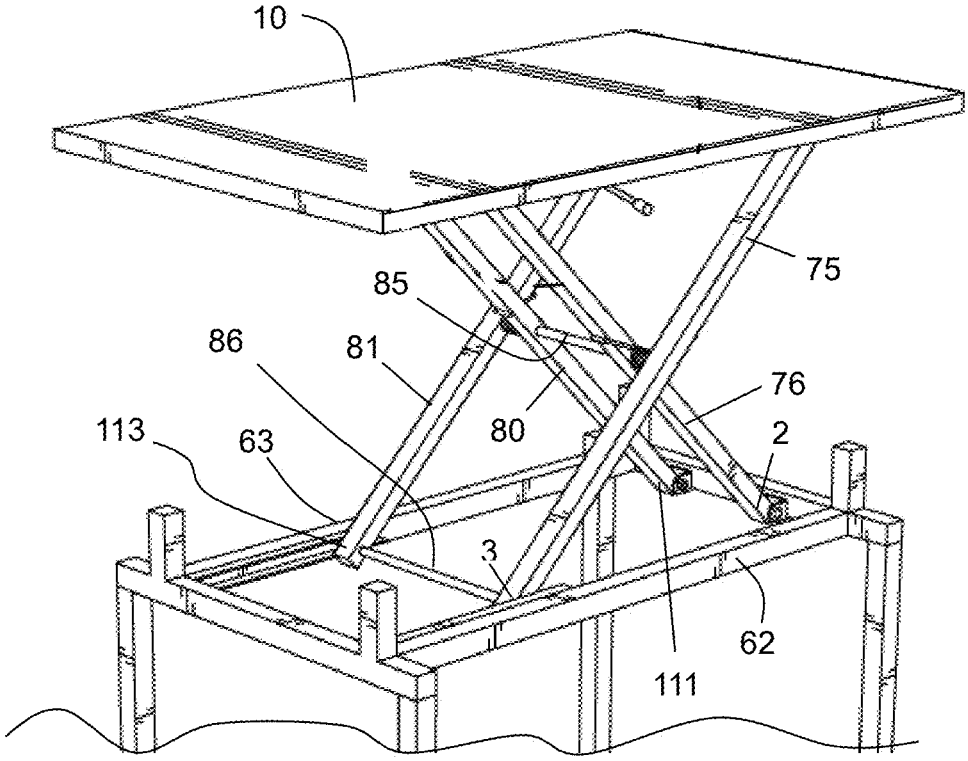
FIG. 4*a* is a perspective view of a height adjustable desk scissor arms in accordance with some embodiments of the presently disclosed subject matter.
Figure 4B:
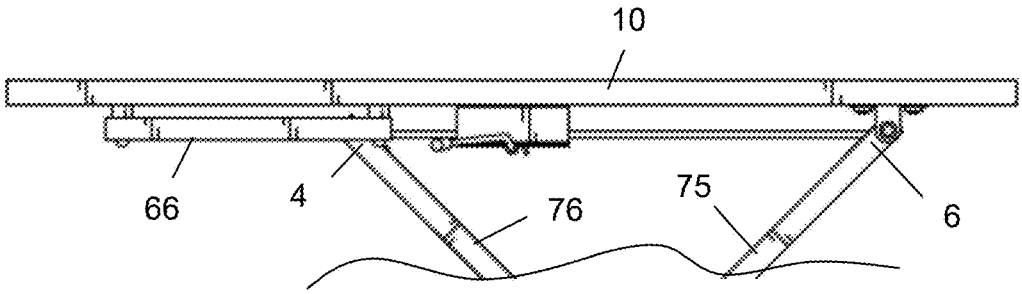
FIG. 4*b* is a side plan view of a height adjustable desk platform in accordance with some embodiments of the presently disclosed subject matter.

As shown in FIG. 4*a*, the desk includes first and second coupled front scissor arms 75, 76 positioned adjacent to front frame arm 62. As shown, the front scissor arms are configured to cross about midway down the lengths of the arms (a pivot point exists where the arms cross, allowing the arms to move relative to each other). The lower end 2 of the second scissor arm 76 is pivotally attached to first frame arm 60, allowing the second scissor arm to rotate relative to the base.

Figure 4C:
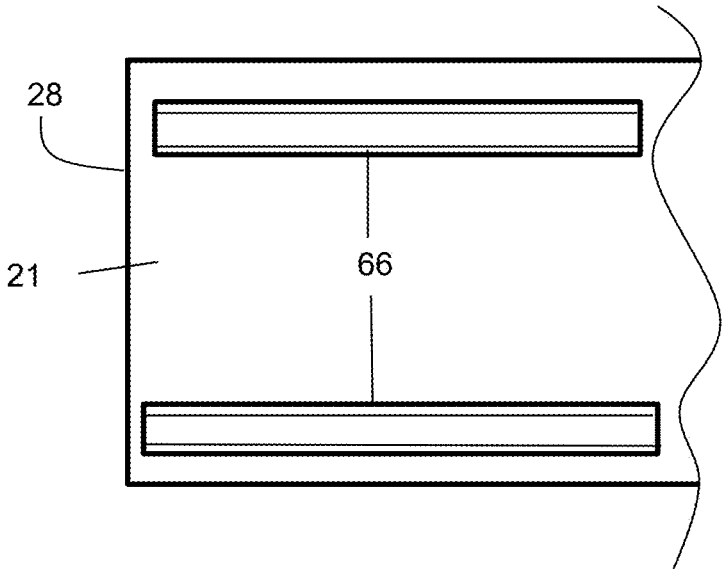
FIG. 4*c* is a fragmentary bottom plan view of a desk platform in accordance with some embodiments of the presently disclosed subject matter.
Figure 4D:
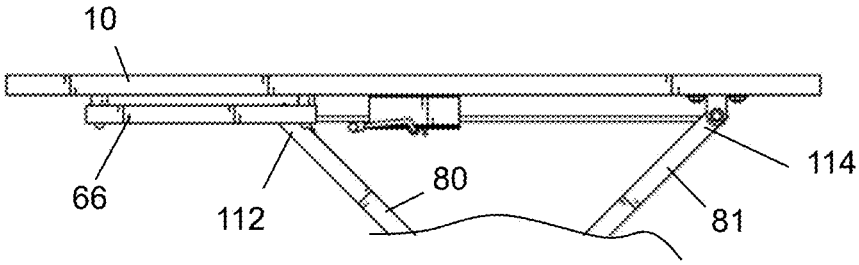
FIG. 4*d* is a side plan view of a height adjustable desk platform in accordance with some embodiments of the presently disclosed subject matter.

Upper end 4 of the second scissor arm 76 attaches to upper connection element 66 (e.g., track) positioned on lower surface 21 of the desktop, as shown in FIG. 4*c*. Similarly, a second upper connection element 66 is also included, allowing for cooperation with the upper end 112 of first rear scissor arm 80, as shown in FIG. 4*d*.

The lower end 3 of the first front scissor arm 75 cooperates with the lower connection element (e.g., track), allowing the scissor arms to move along the track to raise and lower the scissor arms. For example, the upper and/or lower connection elements 65, 66 can be configured as a horizontal track or guides, and a sliding or rolling component attached to an adjacent edge of the first front scissor arm lower end moves within the track or guide to slide the bottom end of the first front scissor arm backwards and forwards to raise and lower the arm. The upper end 6 of first front scissor arm 75 is pivotally attached to a single location on the bottom surface of the desktop. As a result, the first front scissor arm can rotate relative to the frame and/or desktop during raising and lowering.

In addition to the first and second front scissor arms, the desk includes first and second rear scissor arms 80, 81, as shown in FIG. 4*a*. The rear scissor arms are configured similarly or identically to the front scissor arms. The rear scissor arms are positioned adjacent to rear frame arm 63. The rear scissor arms are configured to cross about midway down the lengths of the arms (e.g., with a pivot point allows the arms to move relative to each other). The lower end 111 of first rear scissor arm 80 is pivotally attached to first frame arm 60, allowing end 111 to rotate relative to the frame during raising and/or lowering actions. The upper end 112 of the first rear scissor arm attaches to upper connection element 66 on the lower surface of the desktop, as shown in FIG. 4*d*.

The lower end 113 of the second rear scissor arm 81 cooperates with the lower connection element (e.g., track), allowing the second rear scissor arm end to move along the track to raise and lower the scissor arms. The upper end 114 of second rear scissor arm 81 is pivotally attached to a single location on the bottom surface of the desktop.

Thus, the front and rear pairs of scissor arms cooperate to raise and lower desktop 10. As noted above, the lower ends of second front arm 76 and first rear arm 80 are pivotally connected to the frame structure at frame arm 60. The lower ends of the first front arm and the lower end of the second rear arm are connected to the track 65, allowing the arms to translate forward and backwards along the track. For example, the lower ends of first front scissor arm and second rear scissor arm can be connected to rails that are slidable guided along tracks of the frame.

The scissor arms pivot about each other via a center bar 85 that connects each of the arms 75, 76, 80, and 81 together. The lower ends of the second rear scissor arm and the first front scissor arm also include lower connection bar 86 that keep the legs properly joined and in sync as the scissor arms move up and down and/or about the lower connection element 65. Similarly, the upper ends of the first rear scissor arm and the second front scissor arm can include an upper connection bar 87 that has the same purpose as the lower connection bar, positioned between the arms, adjacent to the bottom surface of the desktop.

The front and rear scissor arms are designed to fit compactly together when desk 5 is in a lower position.

In operation, desktop 10 is movable between a raised position (a maximum height) and a lowered position (a minimum height), and any height between the maximum and minimum. While in the raised position, the desktop is elevated and can be used, for example, while standing. While in the lowered position, the desktop is positioned adjacent to the frame and can be used in a sitting position. In some examples, the desktop can be positioned between the raised and lowered positions.

Figure 5A:
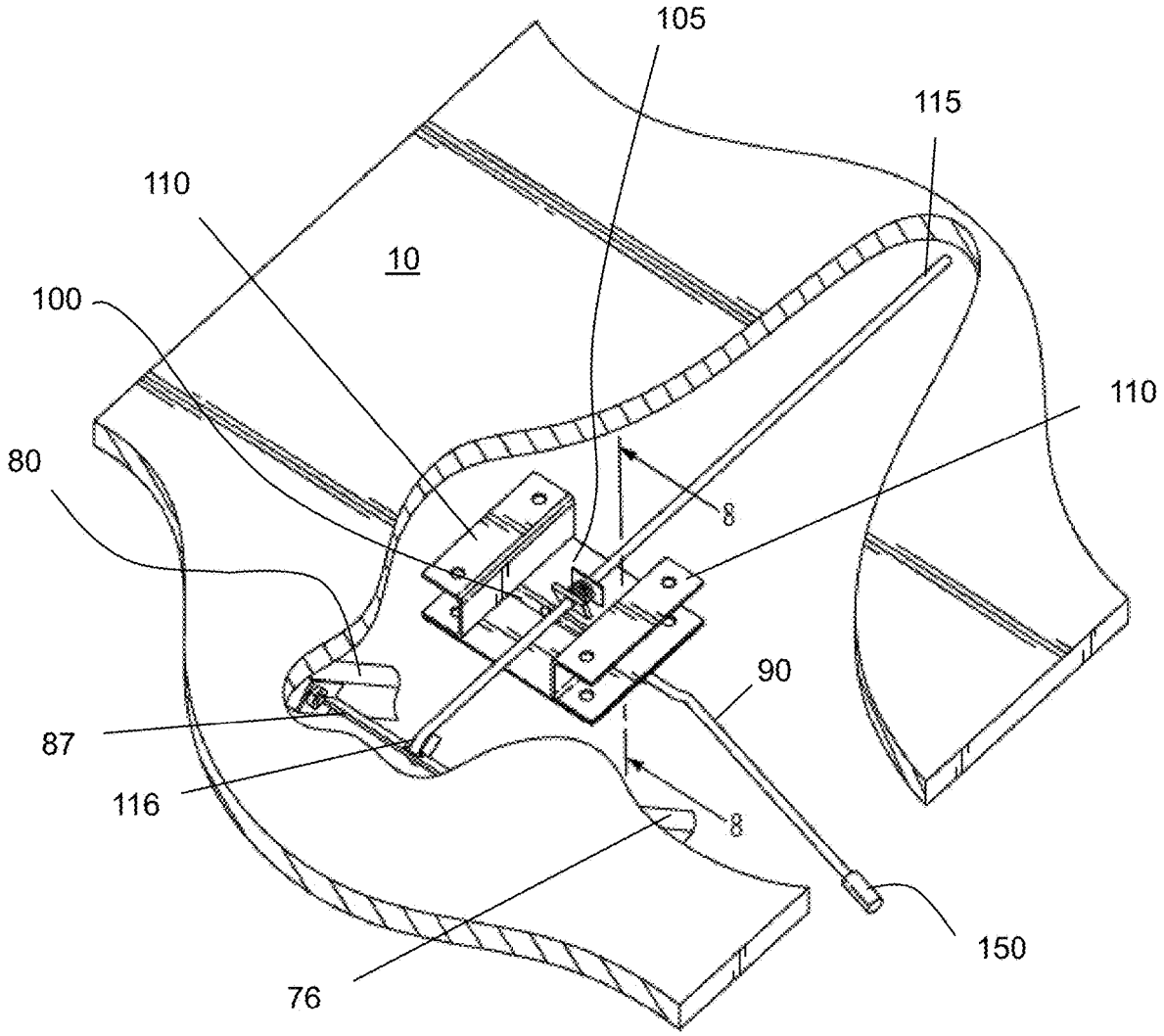
FIG. 5*a* is a cutaway perspective view illustrating a lever that locks and unlocks movement of a height adjustable desk in a locked orientation in accordance with some embodiments of the presently disclosed subject matter.

To unlock the lowering mechanism, a user must push upwards on first end 150 of control lever 90 as shown in FIG. 5*a*. The lever first end can be gripped and manipulated by the user. The second lever end 131 is housed within channel 100 of top plate 105. The top plate also includes a pair of spacers 110 that lock in the lever so that it cannot be moved unless intended by a user. The spacers function to properly position the top plate. The plate cooperates with hook 115, traveling forward and backward allowing the top ends of the second front scissor arm and the first rear scissor arm to move backward and forward along upper track 66. The hook includes looped end 116 that grips or attaches to the bar positioned between the top ends of the second front scissor arm and the first rear scissor arm to guide them forward or backward.

Figure 5B:
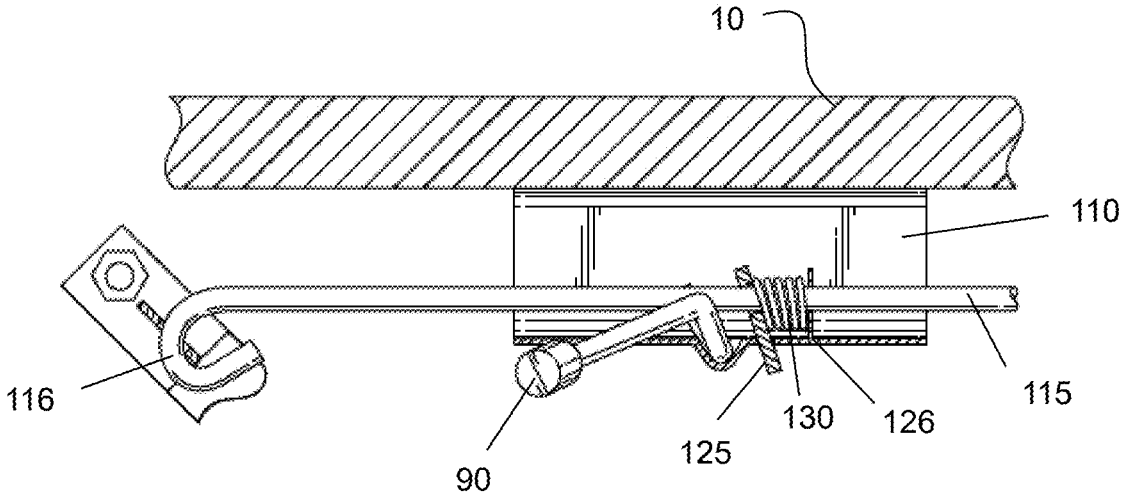
FIG. 5*b* is a side cross-sectional view of a locked lever of a height adjustable desk in accordance with some embodiments of the presently disclosed subject matter.

FIG. 5*b* shows the lever in a locked position, wherein the scissor arms cannot move to lower the desktop. The desk is thus in a "use" position and the desktop has been raised or lowered to a desired height for use/working. The mechanism includes first push bar 125 that is not welded and fits into an opening in the top plate, and second push bar 126 that is welded into the plate and does not move. Spring 130 is positioned between the push bars, as shown.

Figure 5C:
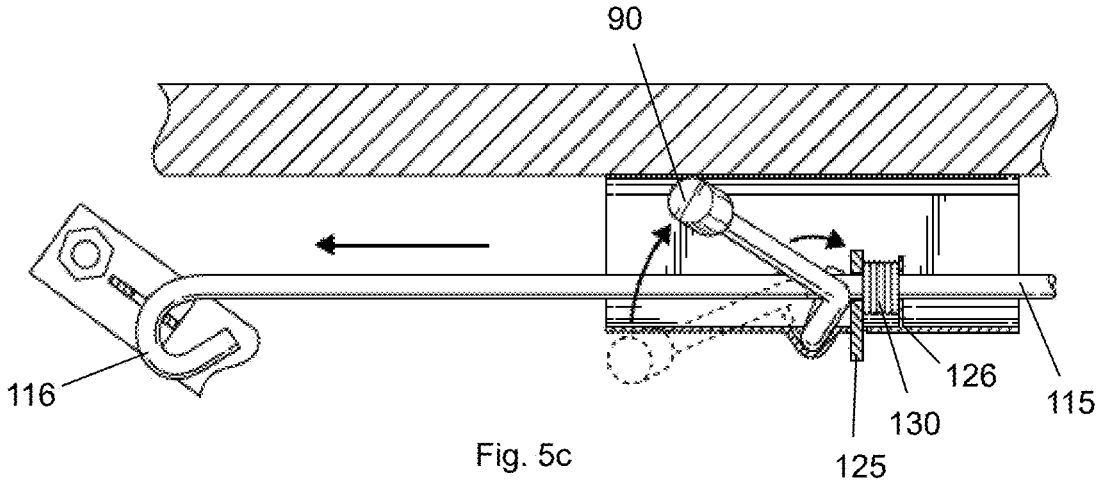
FIG. 5*c* is a side cross-sectional view of an unlocked lever of a height adjustable desk in accordance with some embodiments of the presently disclosed subject matter.
Figure 5D:
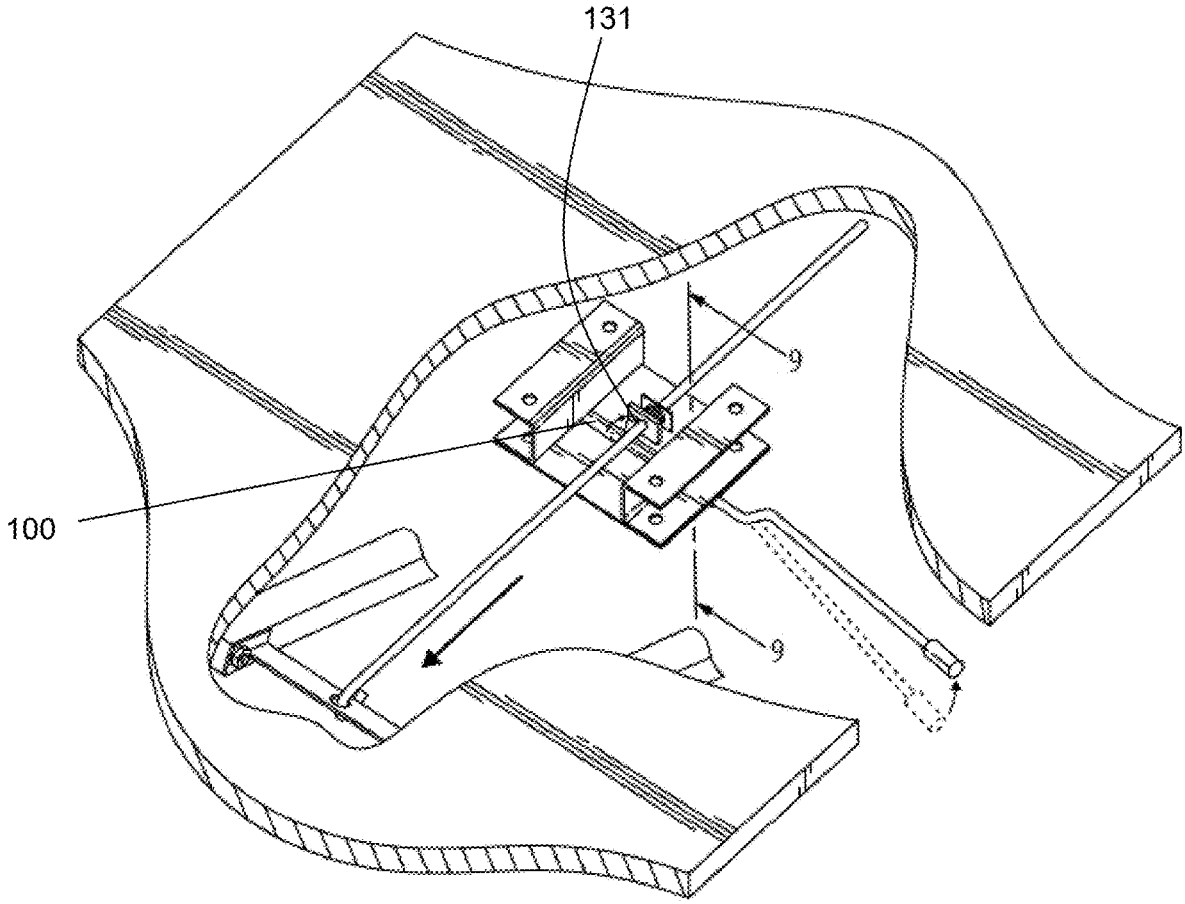
FIG. 5*d* is a cutaway perspective view illustrating a lever of a height adjustable desk in an unlocked position in accordance with some embodiments of the presently disclosed subject matter.

When the lever is pushed upwards, the lowering mechanism is then unlocked as shown in FIGS. 5*c* and 5*d*. Specifically, second end 131 of the lever housed within the channel includes an upturned configuration that is raised when the lever first end is raised, allowing the upturned portion to contact first push bar 125, moving the first push bar towards the second push bar, thereby compressing spring 130. The top plate is then free to move along hook 115 as desired to lower the scissor arms, as shown by the arrow. Because the looped end of the hook is attached to the bar 87 positioned between the upper ends of second front scissor arm 76 and first rear scissor arm 80, the scissor arms move as the bracket travels down the hook. Movement of the upper ends of the second scissor arm and the first rear scissor arm also moves the lower scissor arms along the lower connection element 65, thereby lowering the desktop.

Figure 6A:
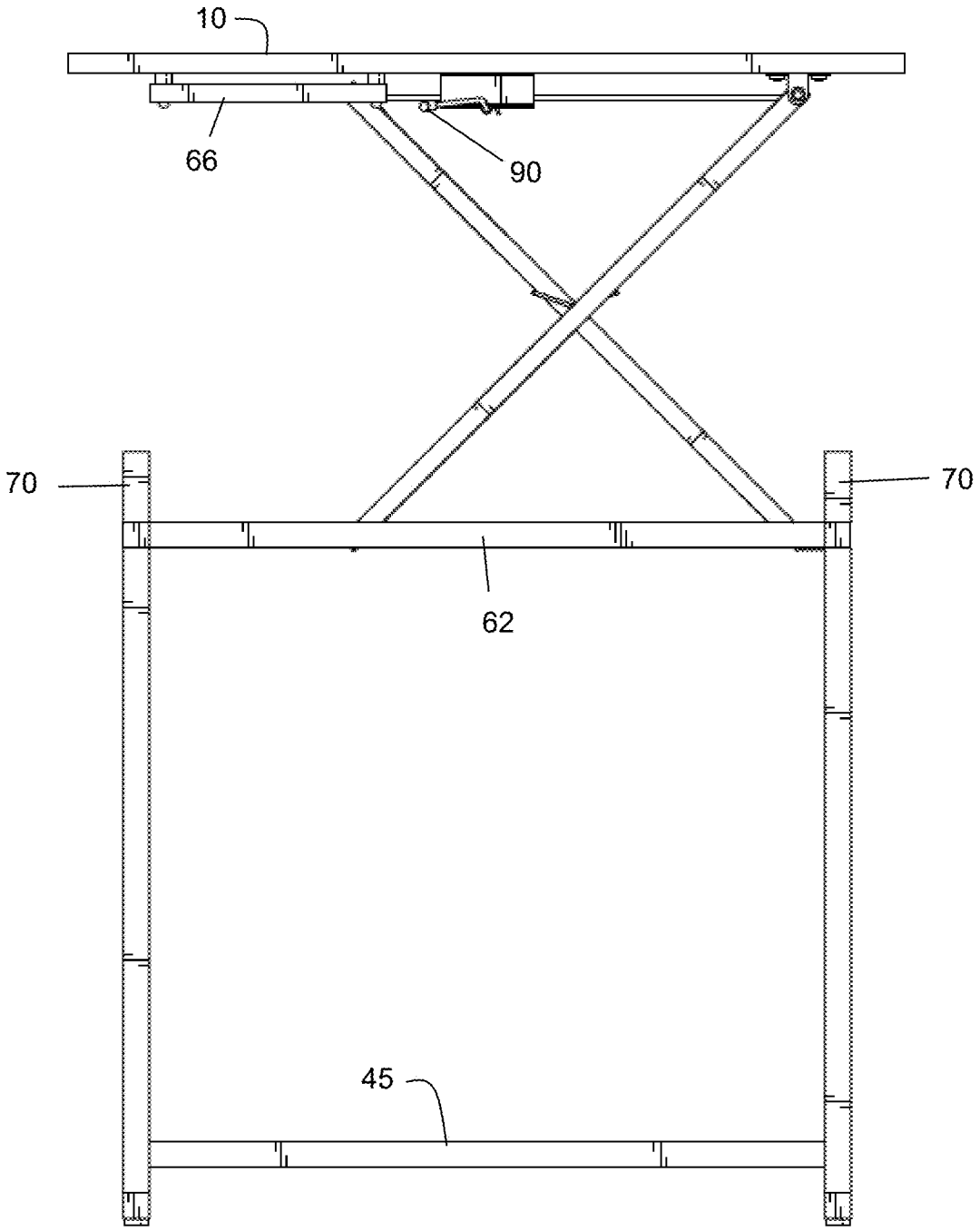
FIG. 6*a* is a front plan view of a height adjustable desk in a fully extended configuration in accordance with some embodiments of the presently disclosed subject matter.

In use, desk 5 can be lowered from the fully or partially raised configuration of FIG. 6*a* to a lowered configuration.

Figure 6B:
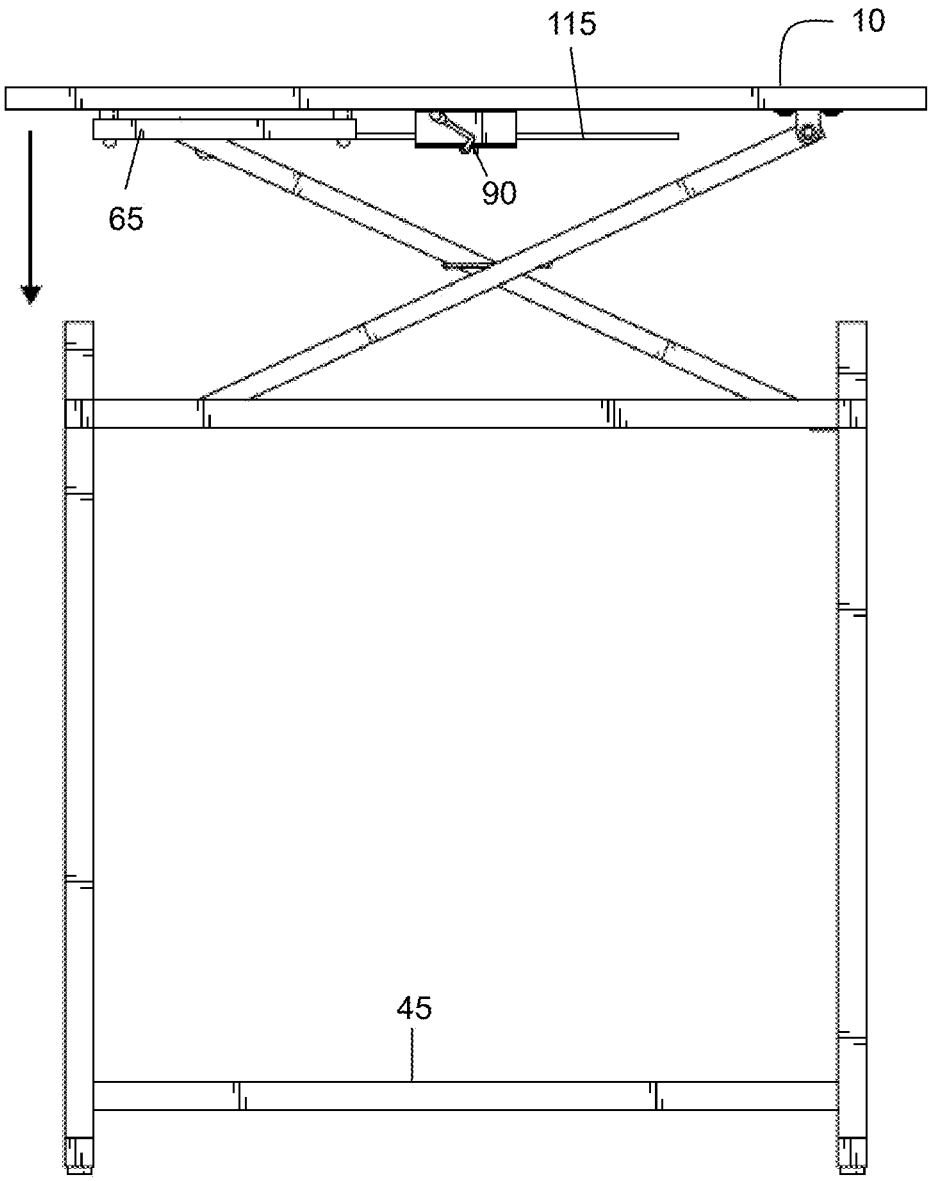
FIGS. 6*b* and 6*c* are front plan views of a height adjustable desk being lowered to a fully retracted configuration in accordance with some embodiments of the presently disclosed subject matter.

The user first lifts or raises the first end of lever 90 to unlock the height adjusting mechanism, as shown in FIG. 6*b*. Second front scissor arm 76 and first rear scissor arm 80 are free to then travel along upper connection element 66. In parallel (and because the arms are attached together using the cross bars), the lower ends of the first front scissor arm and the lower end of the second rear scissor arm travel along lower track connection element 65 to lower the desktop towards base 15, in response to the application of a downward pressure or gravity. Thus, no downward pressure is required (although it can optionally be used) and gravity alone can lower the height of the desktop to a desired level. When a desired height is reached, the lever is again lowered to lock the scissor arms at the desired height. When the lever is released, spring 130 is no longer compressed and the first push bar prevents movement along hook 115, thereby stopping movement of the bracket along the hook (and also stopping movement of the scissor arms). In the fully lowered position of FIG. 6*c*, the bottom surface of the desktop abuts or rests upon bumpers 70 and the arms are neatly folded between the bottom surface of the desktop and the base frame.

Figure 6C:
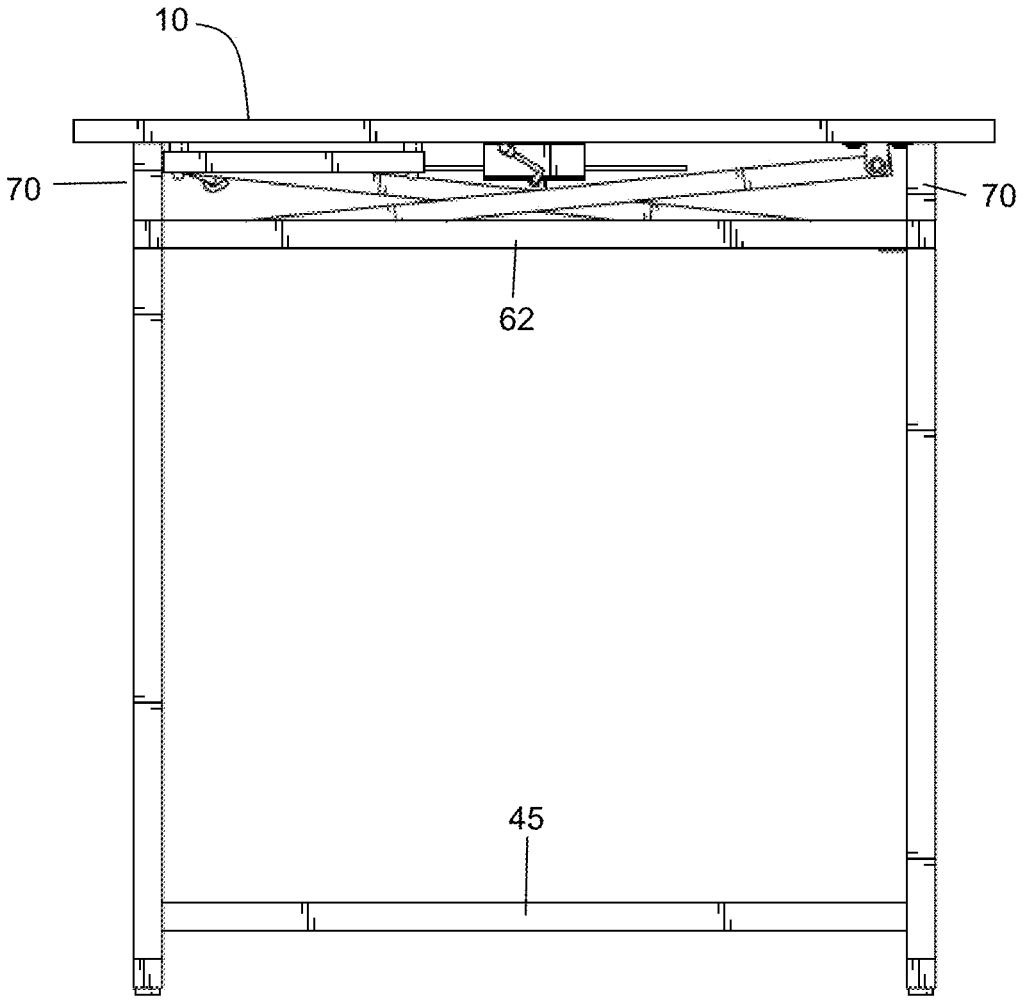
Figure 6D:
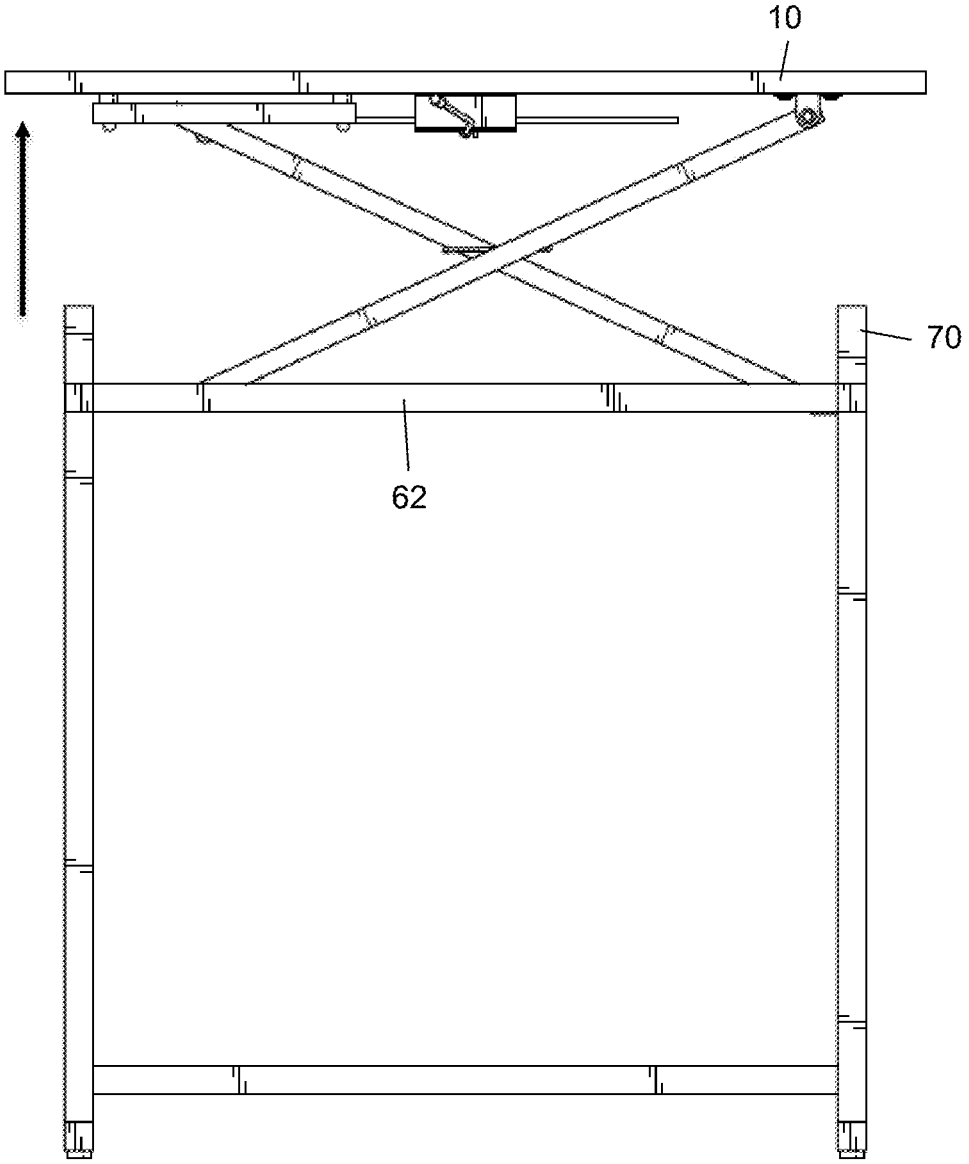
FIGS. 6*d* and 6*e* are front plan views of a height adjustable desk being raised to a fully extended configuration in accordance with some embodiments of the presently disclosed subject matter.
Figure 6E:
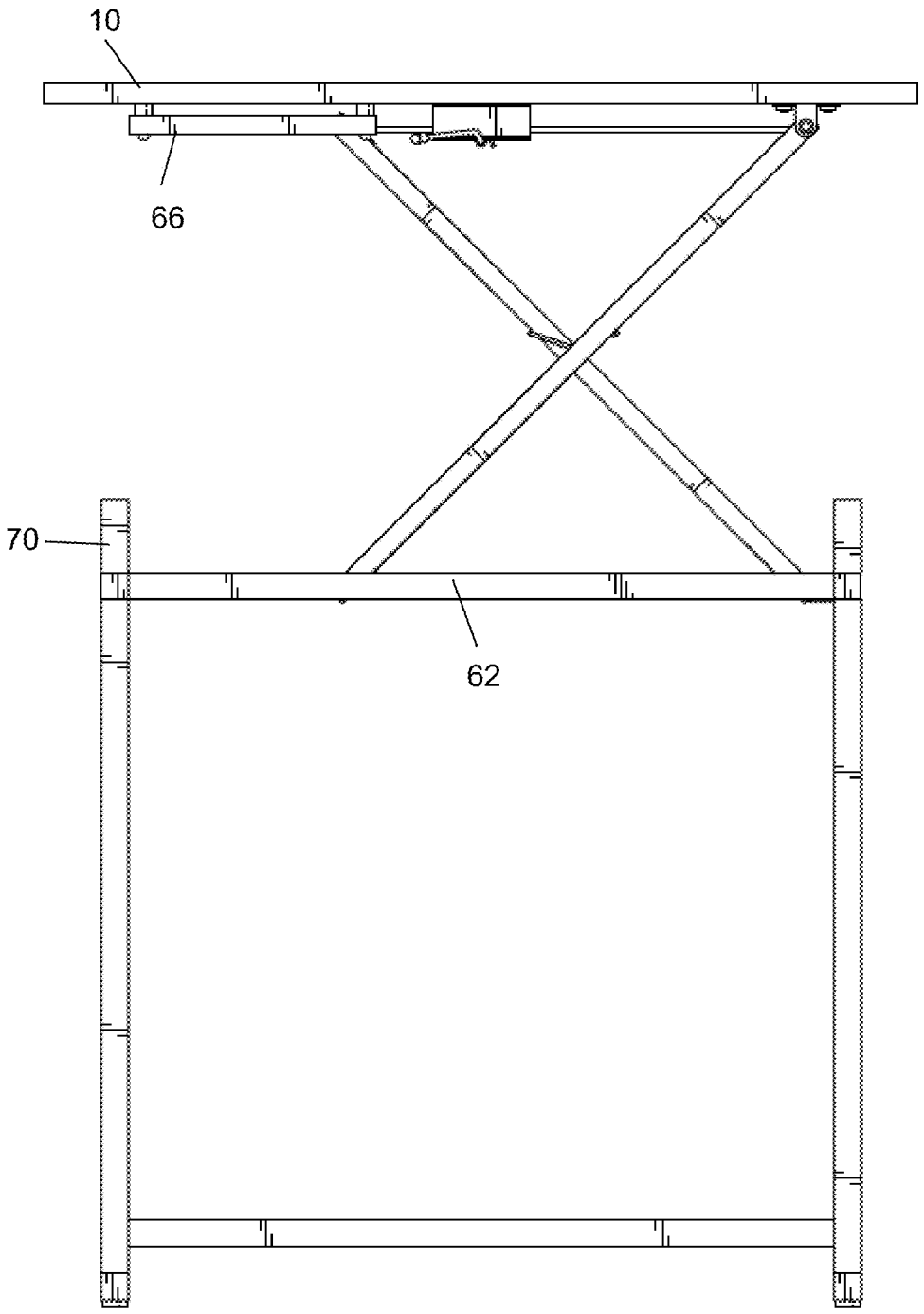

To raise desktop 5 to a higher position relative to the base, the lever does not need to be unlocked. Rather, the desk can be raised at any desired time by the application of an upward lifting motion on the desktop. The upper lifting motion allows the bracket to move along hook 115 (in the opposite direction when compared to the lowering action described above). The upper ends of the second front scissor arm and the first rear scissor arm also are free to travel back along the connection element 66 (and the lower ends of the first front scissor arm and the second rear scissor arms and travel along the lower connection element 65), thereby raising the desktop as shown in FIGS. 6*d* and 6*e*.

The desktop may be adjustable to vary the height using the disclosed desk. For example, the desktop may be adjustable between a collapsed configuration, as shown in FIG. 6*c*, and a fully extended configuration as shown in FIG. 6*a*, as well as any number of intermediate positions. To permit the movement of the desktop between the various heights, the crisscrossing linkages of both scissor arm sets may be pivotably connected together at a central pivot point (including a spring), and the lower ends of each linkage may be pivotably connected to the base and to the lower end of the desktop.

In some embodiments, the desk can be raised using slight to moderate pushing or pulling motion on the desktop. No unlocking of the lever is required to raise the height of the desktop.

The disclosed desk includes many advantages when compared to conventional desks currently being used.

For example, the height adjustable desk 5 can be used to prevent individuals from sitting or standing for prolonged periods of time while they work. Studies have shown that sitting or standing for long periods of time can be detrimental to one's health. As another example, the height adjustable desktop is designed to assist individuals to be more alert and productive as they work. Studies show that moving from a sitting to standing position and vice versa help the human body to be more awake and alert.

Thus, desk 5 provides increased health benefits for users during use (e.g., students during classroom instruction). For example, students can choose to sit or stand during use, avoiding the negative effects of prolonged sitting on the body and spine. As a result, use of the desk is more enjoyable for users and physical health is improved.

The disclosed desk reduces the risk of weight gain and obesity, allowing users to stand as desired or needed. Specifically, standing has been shown to burn more calories and involve more muscular activity compared to sitting, thereby improving blood sugar levels and vascular health. Further, increased standing has been shown to reduce the risk of cancer and diabetes, as well as ease chronic back pain and promote decreases in blood pressure.

Desk 5 further increases posture and balance of users by allowing them to rise from a seated position as desired. For example, when standing the naturing curve in the lumbar spine is preserved. In comparison, sitting exerts about 40% more pressure on the spine compared to standing.

The disclosed desk can increase the attentiveness of a user. For example, it has been shown that standing decreases lethargy and increases attention span. Accordingly, transitioning from a seated to standing position using desk 5 at regular intervals (e.g., every 10, 15, 20, 25, or 30 minutes) can reduce fatigue levels.

Desk 5 can be enjoyed by a wide variety of users, such as (but not limited to) children, students, adults, and the elderly.

The disclosed desk provides a simple structure compared to existing desks, allowing for ease of use.

The disclosed desk requires no electricity for use (e.g., to alternate between raised and lower configurations). Instead, the desk relies on pushing or pulling motion of a user to raise the height of the desktop. Similarly, the desk relies on a downward pressure and/or gravity to lower the desktop (in combination with unlocking of the disclosed lever). Accordingly, the desks can be incorporated into a variety of environments and are not limited by a finite number of electrical outlets. For example, the desks can be used in school classrooms, keeping students more engaged (allowing them to stand when needed), thereby increasing productivity.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A desk comprising:

a desktop defined by:

a planar and flat top surface;

a bottom surface;

a front and an opposed back; and first and second sides;

a base comprising:

a first leg, a second leg, a third leg, and a fourth leg, each leg defined by a top end and an opposed bottom end;

a frame comprising:

a first frame arm extending between the top end of the first leg and the top end of the second leg;

a second frame arm extending between the top end of the third leg and the top end of the fourth leg, wherein the first frame arm is parallel to the second frame arm;

a front frame arm with a first end attached perpendicularly to the first frame arm and a second end attached perpendicularly to the second frame arm;

a back frame arm with a first end attached perpendicularly to the first frame arm and a second end attached perpendicularly to the second frame arm;

a first bumper positioned on the first frame arm and extending upwardly therefrom, positioned adjacent to the first end of the front frame arm;

a second bumper positioned on the first frame arm and extending upwardly therefrom, positioned adjacent to the first end of the back frame arm;

a third bumper positioned on the second frame arm and extending upwardly therefrom, positioned adjacent to the second end of the front frame arm;

a fourth bumper positioned on the second frame arm and extending upwardly therefrom, positioned adjacent to the second end of the back frame arm;

a first lower connection element positioned on an interior face of the front frame arm and a second lower connection element positioned on an interior face of the back frame arm, wherein the first lower connection element faces the second lower connection element;

a first upper connection element positioned on the bottom surface of the tabletop and second upper connection element positioned on the bottom surface of the tabletop, wherein the first upper connection element faces the second upper connection element;

coupled first and second front scissor arms positioned adjacent to the front frame arm, wherein each of the first and second front scissor arms has a lower end and a top end;

coupled first and second rear scissor arms positioned adjacent the back frame arm, wherein each of the first and second rear scissor arms has a lower end and a top end;

wherein the lower end of the second front scissor arm and the lower end of the first rear scissor arm are each pivotally attached to the first frame arm;

wherein the upper end of the first front scissor arm and the upper end of the second rear scissor arm are each pivotally attached to the bottom surface of the tabletop;

wherein the lower end of the first front scissor arm is connected to the first lower connection element and the lower end of the second rear scissor arm is connected to the second lower connection element such that the lower end of the first front scissor arm and the lower end of the second rear scissor arm are configured to move along the first and second lower connection elements, respectively, and the lower end of the second rear scissor arm and the lower end of the first front scissor arm are connected together via a lower bar;

wherein the upper end of the second front scissor arm is connected to the first upper connection element and the upper end of the first rear scissor arm is connected to the second upper connection element such that the upper end of the second front scissor arm and the upper end of the upper end of the first rear scissor arm are configured to move along the first and second upper connection elements, respectively, and the upper end of the second front scissor arm and the upper end of the first rear scissor arm are connected together via an upper bar;

a locking mechanism comprising:

a control lever with a first handle end and an opposed second end housed within a channel of a top plate defined by a pair of opposed spacers;

a first push bar that is not welded, positioned in an opening in the top plate, a second push bar welded into the top plate, and a spring positioned between the first and second push bars;

a hook that passes through an opening on the first push bar, spring, and second push bar, the hook including a hooked end attached to the upper bar;

wherein the locking mechanism transitions from a first locked orientation wherein the plate cannot move along a length of the hook and a second unlocked orientation wherein the second end of the control lever pushes against the first push bar to compress the spring, allowing the plate to move along a length of the hook, allowing the top end of the first rear scissor arm and the top end of the second front scissor arm to move along the upper connection element and also allowing the bottom end of the first front scissor arm and the bottom end of the second rear scissor arm to move along the lower connection element to lower the desktop;

wherein the desk can transition between a first orientation defined by a vertically elevated desktop and a second orientation defined by a lowered desktop, and vice versa.

2. The desk of claim 1, wherein the base comprises 4 legs.

3. The desk of claim 1, wherein the legs each have a length of about 2-5 feet.

4. The desk of claim 1, further comprising a horizontal crossbar that connects one of the plurality of legs to an adjacent leg, wherein the crossbar is positioned adjacent to the bottom end of both legs.

5. The desk of claim 1, further comprising a pair of beams, each beam attached to the bottom end of two legs.

6. The desk of claim 1, wherein the front frame arm attaches to the first frame arm and second frame arm along a length of the first frame arm and along a length of the second frame arm, and not at the first end or second end of the first frame arm or second frame arm, and wherein the back frame arm attaches to the first frame arm and second frame arm along a length of the first frame arm and along a length of the second frame arm, and not at the first end or second end of the first frame arm or second frame arm.

7. The desk of claim 1, wherein the first and second lower connection elements and the first and second upper connection elements are configured as tracks.

8. The desk of claim 1, wherein the bumpers each have a height of about 1-5 inches.

9. The desk of claim 1, further comprising a center pivot bar that connects each of the first front scissor arm, second front scissor arm, first rear scissor arm, and second rear scissor arm together.

10. A method of raising or lowering the desktop of the table of claim 1, the method comprising:

lowering the desktop by lifting the first handle end of the control lever to the unlocked orientation, allowing the second end of the control lever to push against the first push bar to compress the spring, allowing the plate to move along a length of the hook, allowing the top end of the first rear scissor arm and the top end of the second front scissor arm to move along the upper connection element and also allowing the bottom end of the first front scissor arm and the bottom end of the second rear scissor arm to move along the lower connection element, and applying pressure to the desktop in an downward direction or allowing gravity to move the desktop to a lowered height; or raising the desktop by lifting the desktop using an upward lifting motion to raise the desktop without requiring lifting the first handle end of the control lever to the unlocked orientation;

wherein the desktop is raised or lowered as desired by the user.

11. The method of claim 10, wherein the desktop can be positioned between a maximum height and a minimum height.

12. The method of claim 10, wherein the bottom surface of the desktop rests upon the bumpers when in a fully lowered configuration.

13. The method of claim 10, wherein the lifting is performed by the user.

* * * * *